US006188270B1

(12) United States Patent
Boerstler

(10) Patent No.: US 6,188,270 B1
(45) Date of Patent: Feb. 13, 2001

(54) LOW-VOLTAGE REFERENCE CIRCUIT

(75) Inventor: David William Boerstler, Round Rock, TX (US)

(73) Assignee: International Business Machines Corporation, Armonk, NY (US)

( * ) Notice: Under 35 U.S.C. 154(b), the term of this patent shall be extended for 0 days.

(21) Appl. No.: 09/149,159

(22) Filed: Sep. 4, 1998

(51) Int. Cl.[7] ..... G05F 3/02

(52) U.S. Cl. ..... 327/543; 327/513; 327/539; 323/315

(58) Field of Search ..... 327/512, 513, 327/538, 539–541, 544, 543, 530; 323/311–315, 316, 907

(56) References Cited

U.S. PATENT DOCUMENTS 5,739,682 * 4/1998 Kay ..... 323/315
5,818,292 * 10/1998 Slemmer ..... 327/539
5,838,188 * 11/1998 Taguchi ..... 327/530
5,900,773 * 5/1999 Susak ..... 327/539

* cited by examiner

*Primary Examiner*—Timothy P. Callahan
*Assistant Examiner*—Minh Nguyen
(74) *Attorney, Agent, or Firm*—Casimer K. Salys; Felsman, Bradley, Vaden, Gunter & Dillion, LLP

(57) ABSTRACT

A thermal voltage referenced current source has a plurality of current mirrors coupled in an unstacked manner, each powered by a power supply such that the current mirrors operate with approximately equal bias currents, and at least one reference voltage output connected to a node of one of the current mirrors. The unstacked coupling of the current mirrors allows a reference current at the reference voltage output to have a temperature coefficient of about 1000 ppm/°C. This very low temperature dependence can be achieved with power supplies having a voltage of 1.5 volts or less, and the reference current changes by less than about one percent within a wide range of operating temperatures (5 to 105° C.). A gain stage may be formed using a current source, and a pair of source-coupled transistors connected to the current source and controlled by the current mirrors. A bandgap generator can be constructed using the foregoing thermal voltage reference circuit, which has a positive temperature coefficient, in combination with a negative temperature coefficient base-to-emitter voltage ($V_{be}$) reference circuit, or by providing a suitable choice of resistor material.

9 Claims, 4 Drawing Sheets

LOW-VOLTAGE REFERENCE CIRCUIT

BACKGROUND OF THE INVENTION

1. Field of the Invention

The present invention generally relates to voltage sources for electronic devices, particularly low-power voltage sources for analog circuits, and more specifically to a circuit for providing a low-voltage reference which is highly temperature stable (i.e., has low effective temperature coefficients) and supply voltage stable.

2. Description of Related Art

Modern electronic devices employ a wide variety of integrated circuits to carry out various logic functions, including simple designs for, e.g., wristwatches, and more complicated designs for, e.g., data processing systems. An integrated circuit (IC) is essentially a multitude of interconnected circuit elements, such as logic gates, amplifiers, inverters, etc., which are formed of electrical components such as transistors, diodes, resistors, etc. These components are miniaturized, and fabricated on a common substrate.

The substrate of an integrated circuit is formed of a semiconductor material, such as silicon or germanium, which has been doped (mixed with certain impurities) in a pattern to create solid state elements, such as complementary metal-oxide semiconducting (CMOS) devices. An IC can be single layer, with interconnecting leads formed on the substrate between circuit elements, or multi-layer, with interconnecting vias formed between adjacent and non-adjacent layers.

A primary challenge in designing precision integrated circuits is to control circuit parameters, such as bias currents, in view of temperature variations and supply variations. During the design of integrated circuits, anticipating and controlling operating fluctuations due to changes in environmental conditions such as temperature, requires a complicated analysis. Temperature sensitivity, fabrication variations and supply voltage variations exhibit complex relationships among each other. In integrated circuits, precision oscillators (more particularly, oscillators with feedback) are designed to comply with exacting specifications that have little margin for deviation. Surmounting these tight tolerances over a wide range of temperatures is very challenging for a designer. For such oscillators, these difficulties are exacerbated by today's higher frequency requirements. Precision circuits which are very sensitive to temperature variations include voltage-controlled oscillators, which are used in phase-lock loop circuits that provide clock signals to, e.g., high-speed data processing systems.

A variety of techniques are known for stabilization of a circuit over a temperature range which the circuit may endure. For example, temperature variations in a voltage-controlled oscillator can be significantly reduced by temperature-independent biasing techniques. One problem with this approach, however, relates to the use of lower power voltage supplies for the reference circuits.

In general, as CMOS technology continues to evolve to lower supply voltages, most existing analog circuits designed for higher supply voltages will fail to operate due to the large degree of device stacking. Reference circuits in particular, such as thermal voltage ($V_{therm}$) or bandgap generators, are often composed of four levels of stacking, and have poor characteristics below a power supply ($V_{dd}$) of about 1.5 volts. FIG. 1 shows a common $V_{therm}$-referenced current source. Transistors $Q_1$ and $Q_2$ have areas that differ by a factor of n, and the feedback loop formed by CMOS devices $M_1$, $M_2$, $M_3$, and $M_4$ forces these two transistors to operate at the same bias current. As a result, the circuit's output current $I_{out}$ is equal to $[V_{therm}*\ln(n)]/R$, where R is the resistance of resistor R, and $V_{therm}$ is kT/q (k is Boltzmann's constant, T is absolute temperature, and q is electron charge). It turns out that both R and $V_{therm}$ have positive temperature coefficients (TCs), which yield a relatively temperature-independent output current for supply voltages above 1.5 volts; however, the four levels of stacking ($M_4$, $M_2$, R, $Q_2$) make it unsuitable for lower voltages.

Another temperature-independent biasing technique uses base-to-emitter voltage ($V_{be}$) referencing, as shown in FIG. 2. In this design, the same feedback loop is present, but the absence of a second transistor makes the output current $I_{out}$ equal to $V_{be}/R$, where $V_{be}$ is the base-to-emitter voltage of transistor $Q_1$. This approach may be implemented with 3-high stacking, but it still has a large overall negative TC due to the negative TC of $V_{be}$, and to the large positive TC of diffused and polysilicon resistors.

Bandgap generators use a weighted combination of $V_{therm}$ and $V_{be}$ generators to produce very low temperature dependence, as seen in FIG. 3. The circuit's output current $I_{out}$ is equal to $V_o/R_2$, where $R_2$ is the resistance of resistor $R_2$ and $V_o$ (the output voltage) is equal to $V_{be}+xV_{therm}\ln(n)$. The parameter "x" (the multiplier for the resistor connected to the input of the operational amplifier) represents the weighting of the $V_{therm}$-dependent portion of the output voltage. While this design can thus be tuned to substantially reduce overall temperature dependence, it still suffers at low supply voltages ($V_{dd}$), from the large degree of device stacking in the $V_{therm}$ generator (four levels of stacking).

In light of the foregoing, it would be desirable to devise a voltage reference circuit for low $V_{dd}$ applications which has an improved effective temperature coefficient. It would be further advantageous if the circuit could be used in high-speed oscillator applications.

SUMMARY OF THE INVENTION

It is therefore one object of the present invention to provide an improved voltage reference circuit which can be used with digital or analog circuits.

It is another object of the present invention to provide such a voltage reference circuit which has a relatively low effective temperature coefficient.

It is yet another object of the present invention to provide such a voltage reference circuit which retains its temperature-independence for supply voltages lower than about 1.5 volts, and which is insensitive to supply voltage variations.

The foregoing objects are achieved in a circuit providing a thermal voltage referenced current source, generally comprising a power supply, a plurality of current mirrors coupled in an unstacked manner, each powered by the power supply such that the current mirrors operate with approximately equal bias currents, and at least one reference voltage output connected to a node of one of the current mirrors, wherein a reference current at the reference voltage output has a temperature coefficient with an absolute value of no more than about 1000 ppm/°C. This very low temperature dependence can be achieved using this unstacked construction with power supplies having a voltage of 1.5 volts or less. In an illustrative embodiment, the reference current changes by less than about one percent within a wide range of operating temperatures (5 to 105° C.). A gain stage may be formed using a current source, and a pair of source-coupled transistors connected to the current source and controlled by the current mirrors. For an undesirable case where the currents in the circuit are near zero, means can be provided for injecting a current into the current mirrors to correct the state. A bandgap generator can be constructed using the foregoing thermal voltage reference circuit, which has a positive temperature coefficient, in combination with a negative temperature coefficient base-to-emitter voltage ($V_{be}$)

reference circuit, to yield a reference circuit having an even lower overall temperature dependence.

The above as well as additional objectives, features, and advantages of the present invention will become apparent in the following detailed written description.

BRIEF DESCRIPTION OF THE DRAWINGS

The novel features believed characteristic of the invention are set forth in the appended claims. The invention itself, however, as well as a preferred mode of use, further objectives, and advantages thereof, will best be understood by reference to the following detailed description of an illustrative embodiment when read in conjunction with the accompanying drawings, wherein:

DESCRIPTION OF AN ILLUSTRATIVE EMBODIMENT

Figure 1:
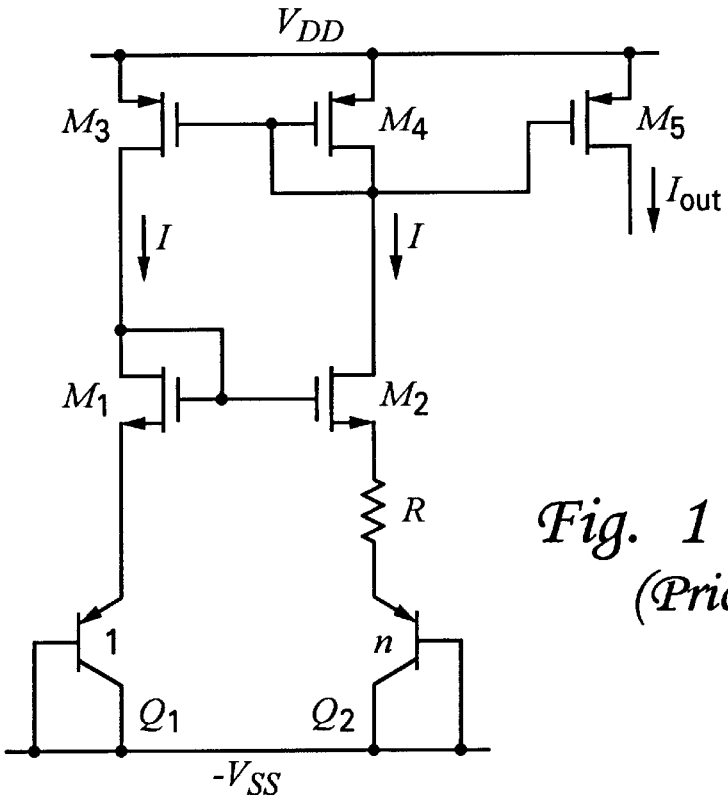
Fig. 1 (Prior Art)
FIG. 1 s a schematic diagram of a prior art biasing circuit using $V_{therm}$-referenced biasing to achieve relatively temperature-independent operation (i.e., a low effective temperature coefficent)
Figure 2:
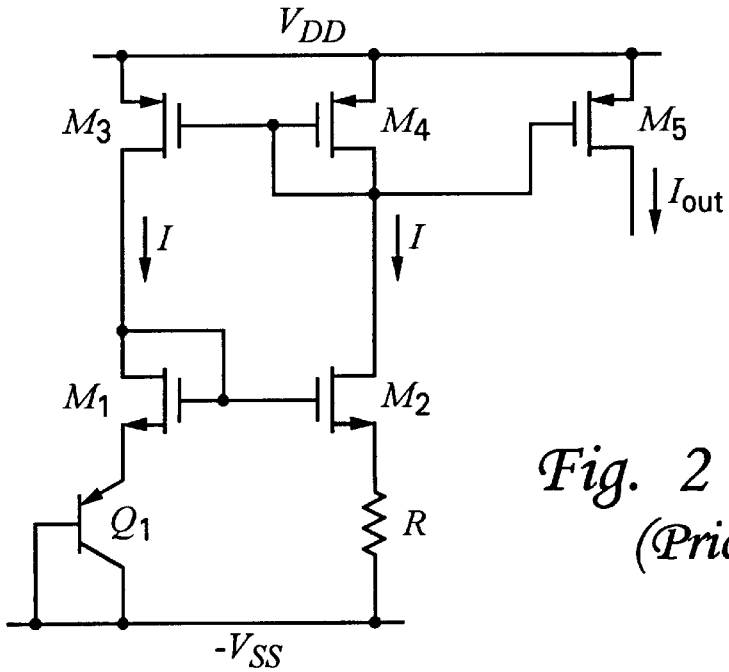
Fig. 2 (Prior Art)
FIG. 2 is a schematic diagram of a prior art biasing circuit using $V_{be}$-referenced biasing.
Figure 3:
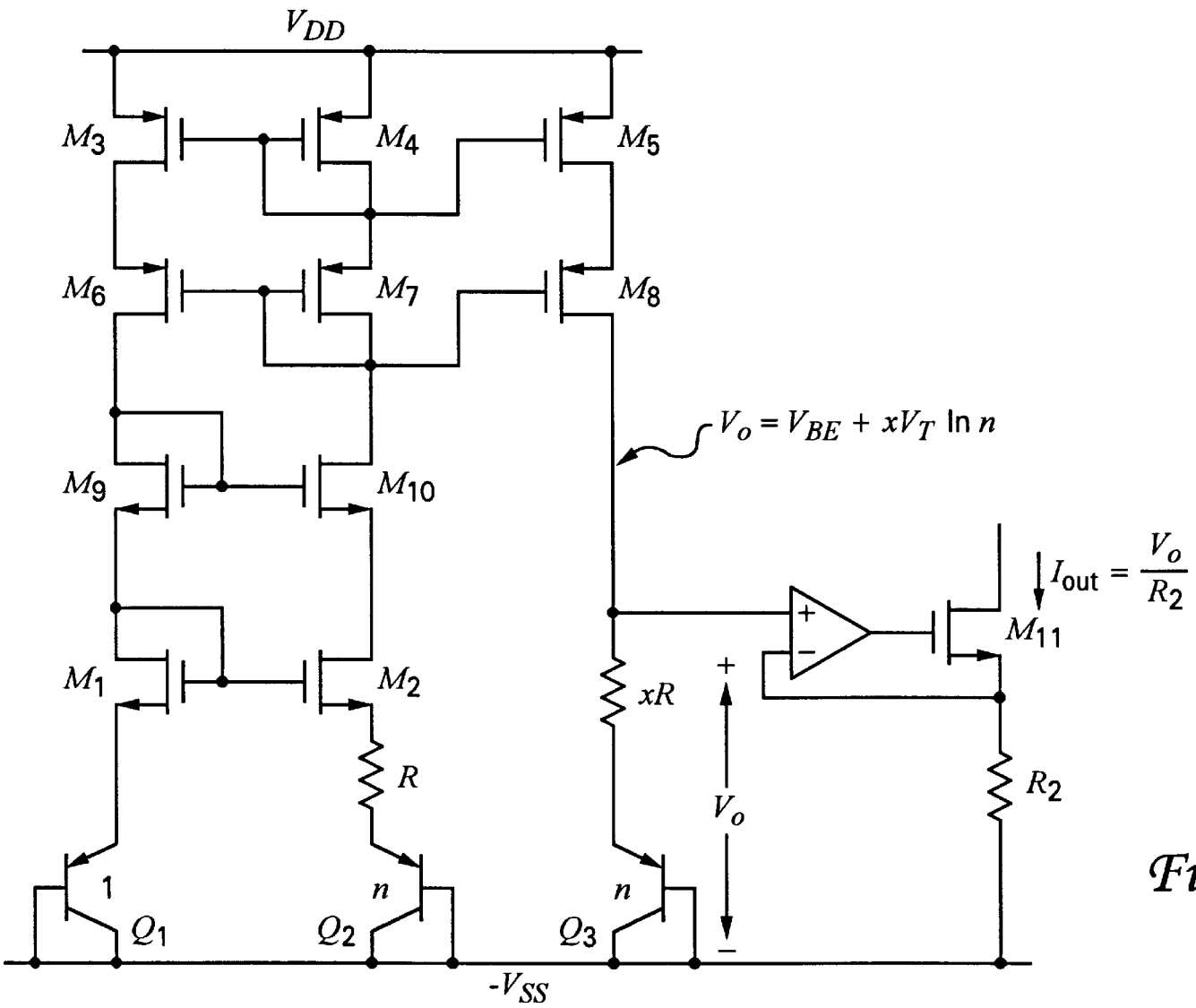
Fig. 3 (Prior Art)
FIG. 3 is a schematic diagram of a prior art bandgap generator using a weighted combination of $V_{therm}$ and $V_{be}$ referencing to produce low temperature dependence.
Figure 4:
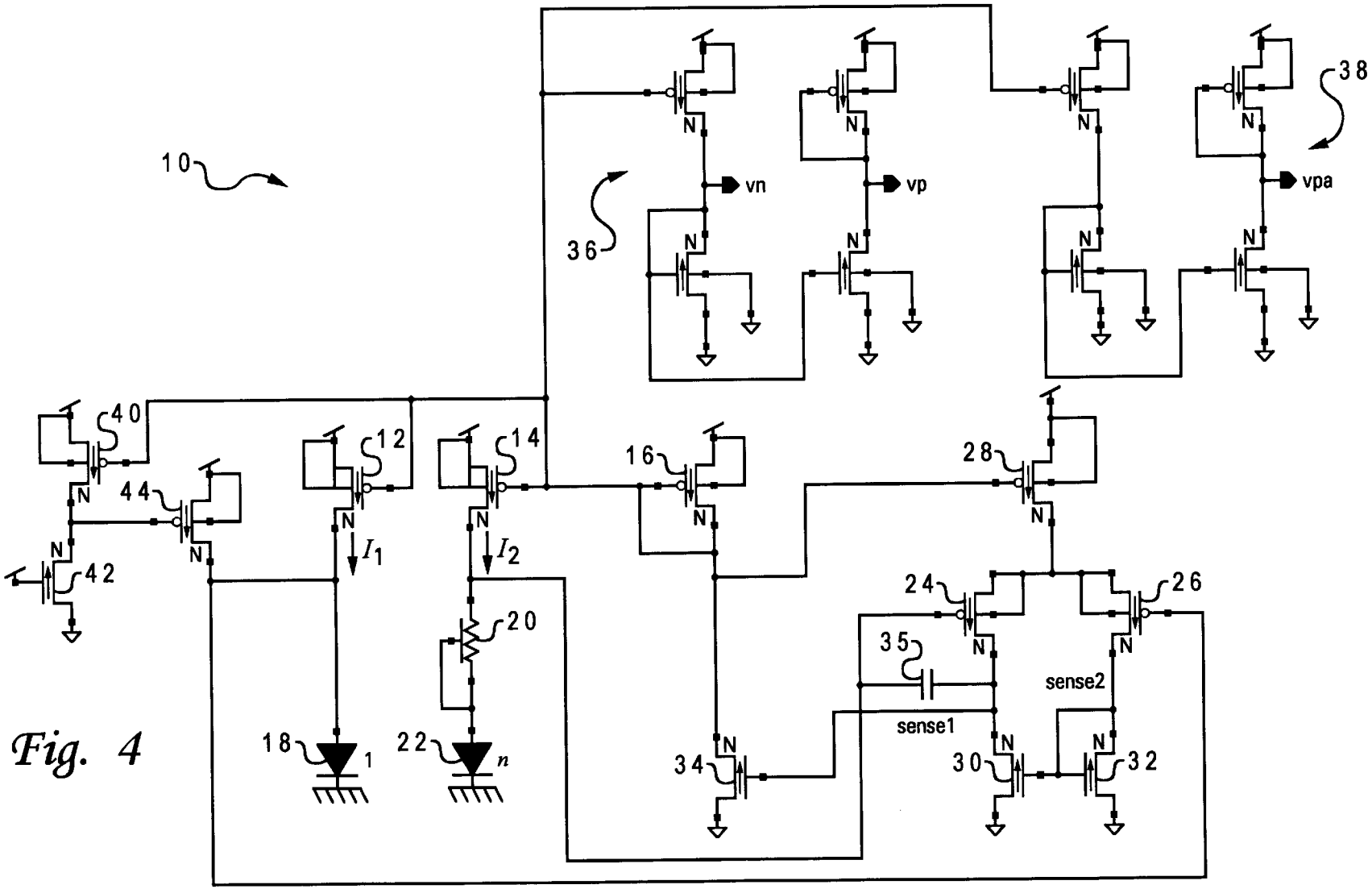
FIG. 4 is a schematic diagram of one embodiment of a $V_{therm}$-referenced biasing circuit constructed in accordance with the present invention, which provides relatively temperature- and supply-independent operation and is suitable for lower supply voltages.

With reference now to the figures, and in particular with reference to FIG. 4, there is depicted one embodiment of a reference voltage circuit 10 constructed in accordance with the present invention. Circuit 10 provides a $V_{therm}$-referenced current source, and is utilized within an integrated circuit. As will become apparent to those skilled in the art, circuit 10 is particularly useful for low $V_{dd}$ applications, including use as a voltage reference for a voltage-controlled oscillator (VCO) used in a phase-lock loop (PLL) clocking circuit.

The gates of two p-type field-effect transistors (pfets) 12 and 14 are connected to the gate of another pfet 16 to form current mirrors. The sources of each of these pfets is connected to the analog voltage supply $AV_{dd}$. The body of each pfet is connected to its respective source (all of the transistors described herein have such a body-source connection). Pfets 12 and 14 thus provide approximately equal currents $I_1$ and $I_2$ at their respective drains. Current $I_1$ flows through a first diode 18, while current $I_2$ flows through a non-salicided n-type MOSFET resistor 20 and a second diode 22. Diode 22 is N times the area of diode 18 (N=10 in this exemplary embodiment). Diodes 18 and 22 are operated in the exponential region.

Two other pfets 24 and 26 comprise a pair of source-coupled transistors biased by a current source from another pfet 28. The source of pfet 28 is connected to $AV_{dd}$ and its gate is connected to the gates of pfets 12, 14 and 16. The active loads at n-type field-effect transistors (nfets) 30 and 32 are connected to the p-type source-coupled pair 24,26 and the current source to create a gain stage. The gain stage output voltage at the drains of transistors 24 and 30 (sense1) is converted to a current by another nfet 34, which drives the mirroring device 16, completing a feedback network. The current source for the gain stage is mirrored from pfet 16. A compensation capacitor 35 is connected across the gate and drain at pfet 24 for added stability; other placement options exist. Additional mirrors 36 and 38 are shown at the top of FIG. 4 which are boosted for use in the subsequent stages and for generating reference voltages $V_n$, $V_P$ and $V_{pa}$ at respective nodes of the mirrors.

For large gains, the voltage at the drains of pfets 12 and 14 are approximately equal (to first order), and the output current $I_{ref}$ is given by the equation $$I_{ref} = \frac{kT}{Rq}\ln(N)$$

for $I_{ref}=I_1=I_2$, where k is Boltzmann's constant (~$1.38\times10^{-23}$ Joule/°K.), T is temperature in degrees Kelvin, q is electron charge (~$1.602\times10^{-19}$ coulombs), R is resistance in Ohms, and N is the area of diode 22 compared to the area of diode 18. It can be shown from the foregoing equation that the temperature dependence of the current, expressed relative to the current, is given by the equation $$\frac{1}{I}\frac{dI}{dT} = \frac{1}{T} - \frac{1}{R}\frac{dR}{dT}.$$

At room temperature, 1/T is about 0.3333%/°C. Typical resistor materials result in 1/R dR/dT values in the range of 0.20%/°C. to 0.37%/°C.

For a copper-based resistor, having a 1/R dR/dT value of about 0.33%/°C., the temperature dependence is thus approximately zero. Low supply voltage dependence is enhanced by the absence of device stacking in this embodiment.

Figure 5:
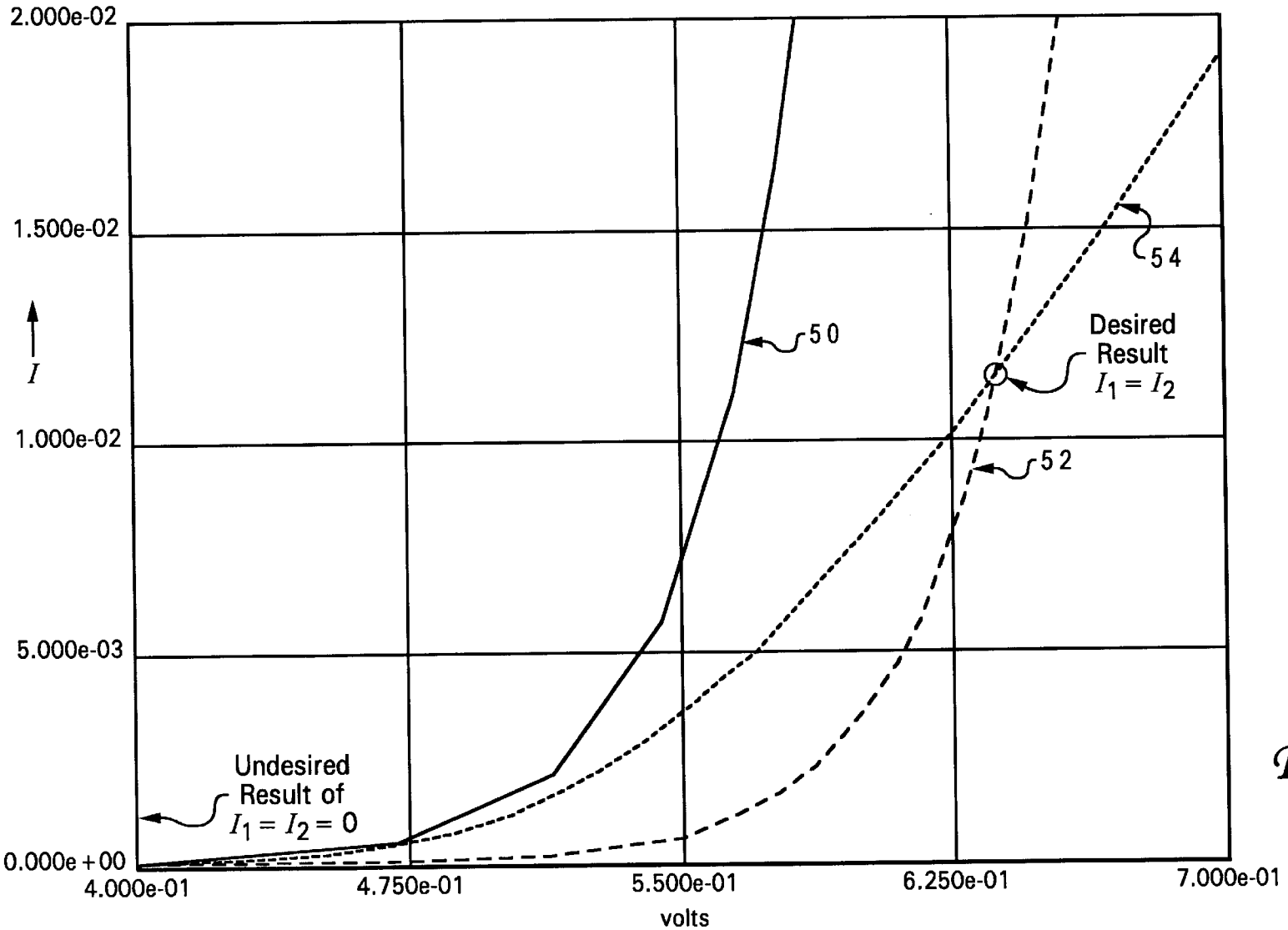
FIG. 5 is a graph of selected currents in the circuit of FIG. 4, illustrating how positive feedback forces a correct state for zero voltage and current.

FIG. 5 is a graph illustrating the responses of currents $I_1$ and $I_2$. Curve 50 is the response for a large area diode (22), which has a lower turn-on voltage than the small area diode (18), whose response is shown in curve 52. The response of the large area diode in series with the resistor is shown in curve 54. An undesired solution at zero voltage and current exists for this circuit. This undesired state is controlled by pfet 40, nfet 42 and pfet 44 which inject about 6.6 $\mu$A of current at a supply voltage $AV_{dd}$ of 1.8 V. Through positive feedback, this injected current forces the correct state and shuts off device pfet 44 by means of the current mirror at pfet 40. Pfet 40 is sized large enough (four times the size of pfet 12) to keep its drain-to-source voltage $V_{ds}$ small, and shut off pfet 44 at higher $V_{dd}$ voltages.

Due to the partial cancellation of the temperature coefficients in circuit 10, the reference current $I_{ref}$ (using conventional resistor fabrication) has a TC of about +1003 ppm/°C. for the operating range of 5 to 105° C., as compared to −3798 ppm/°C. for a typical $V_{be}$ reference device. Using standard bandgap design approaches, a positive temperature coefficient (+TC) thermal voltage-based reference current constructed in accordance with the foregoing may be weighted with a negative temperature coefficient (−TC) $V_{be}$ reference current, to produce very low effective TC references (10 ppm/°C. or less). The resistor's TC must be known for effective bandgap design.

The embodiment of FIG. 4 has been simulated in CMOS7S technology and operates well at relatively low supply voltages, i.e., lower than 1.5 V, and as low as 0.833 V at 85° C. For a supply voltage $V_{dd}$ between 1.0 V and 2.5 V, the reference current changes by less than ±1.1% at 85° C.

Although the invention has been described with reference to specific embodiments, this description is not meant to be construed in a limiting sense. Various modifications of the disclosed embodiments, as well as alternative embodiments of the invention, will become apparent to persons skilled in the art upon reference to the description of the invention. It is therefore contemplated that such modifications can be made without departing from the spirit or scope of the present invention as defined in the appended claims.

What is claimed is:

1. A reference circuit comprising:

a power supply;

a ground plane;

a first transistor having a source connected to said power supply, a drain coupled to said ground plane, and a gate connected to said drain;

a first current path;

a second transistor having a source connected to said power supply, a drain connected to said first current path, and a gate connected to said gate of said first transistor;

a second current path;

a third transistor having a source connected to said power supply, a drain connected to said second current path, and a gate connected to said gate of said first transistor;

a reference voltage output;

a fourth transistor having a source connected to said power supply, a drain connected to said reference voltage output, and a gate connected to said gate of said first transistor;

a fifth transistor having a source connected to said power supply, and a gate connected to said gate of said first transistor;

a sixth transistor having a source connected to said power supply, a gate connected to a drain of said fifth transistor, and a drain connected to said drain of said second transistor; and a seventh transistor having a source connected to said ground plane, a gate connected to said power supply, and a drain connected to said drain of said fifth transistor.

2. The reference circuit of claim 1 wherein:

said first current path includes a first diode having first and second leads, said first lead being connected to said ground plane, and said second lead being connected to said drain of said second transistor;

said second current path includes a resistor having first and second leads, said first lead of said resistor being connected to said drain of said third transistor, and a second diode having first and second leads, said first lead of said second diode being connected to said ground plane, and said second lead of said second diode being connected to said second lead of said resistor, wherein said second diode has an area which is greater than an area of said first diode.

3. The reference circuit of claim 1 wherein a reference current at said reference voltage output has a temperature coefficient with an absolute value of no more than about 1000 ppm/°C.

4. The reference circuit of claim 1 wherein said reference voltage output is a first reference voltage output, and further comprising:

a second reference voltage output; and a current mirror coupling said second reference voltage output to said first reference voltage output.

5. A bandgap generator using the reference circuit of claim 1, wherein the reference circuit is a thermal voltage reference circuit having a positive temperature coefficient, and further comprising a negative temperature coefficient base-to-emitter voltage reference circuit coupled to the thermal voltage reference circuit.

6. The bandgap generator of claim 5 wherein the positive and negative temperature coefficients result in an effective overall temperature coefficient having an absolute value of no more than about 10 ppm/°C.

7. The reference circuit of claim 1 wherein said second current path includes a resistor constructed of a material yielding a temperature coefficient for said resistor which effectively cancels a temperature coefficient for other components of the circuit.

8. A reference circuit comprising:

a power supply;

a ground plane;

a first transistor having a source connected to said power supply, a drain coupled to said ground plane, and a gate connected to said drain;

a first current path;

a second transistor having a source connected to said power supply, a drain connected to said first current path, and a gate connected to said gate of said first transistor;

a second current path;

a third transistor having a source connected to said power supply, a drain connected to said second current path, and a gate connected to said gate of said first transistor;

a reference voltage output;

a fourth transistor having a source connected to said power supply, a drain connected to said reference voltage output, and a gate connected to said gate of said first transistor;

a fifth transistor having a source connected to said ground plane, and a drain connected to said drain of said first transistor;

a sixth transistor having a gate connected to said drain of said third transistor, and a drain connected to a gate of said fifth transistor;

a seventh transistor having a gate connected to said drain of said second transistor, and a source connected to a source of said sixth transistor, such that said sixth and seventh transistors form a pair of source-coupled transistors;

an eighth transistor having a source connected to said ground plane, a drain connected to said gate of said fifth transistor;

a ninth transistor having a gate connected to a gate of said eighth transistor, a drain connected to said ground plane, and a source connected to said gate of said ninth transistor and to said drain of said seventh transistor; and a tenth transistor having a gate connected to said drain of said first transistor, a source connected to said power supply, and a drain connected to said sources of said sixth and seventh transistors.

9. The reference circuit of claim 8 further comprising:

an eleventh transistor having a source connected to said power supply, and a gate connected to said gate of said first transistor;

a twelfth transistor having a source connected to said power supply, a gate connected to a drain of said eleventh transistor, and a drain connected to said drain of said second transistor; and a thirteenth transistor having a source connected to said ground plane, a gate connected to said power supply, and a drain connected to said drain of said eleventh transistor.

* * * * *